US006102496A

United States Patent [19]

Parham

[11] Patent Number: 6,102,496

[45] Date of Patent: Aug. 15, 2000

[54] MERCHANDISING DISPLAY CABINET

[75] Inventor: Dennis E. Parham, Kennesaw, Ga.

[73] Assignee: Display Industries, LLC., Smyrna, Ga.

[21] Appl. No.: 09/021,602

[22] Filed: Feb. 10, 1998

[51] Int. Cl.[7] ..... A47F 3/00

[52] U.S. Cl. ..... 312/138.1; 312/234.3; 312/328

[58] Field of Search ..... 312/138.1, 234.3, 312/234.5, 326, 327, 328, 329; 43/100, 105; 256/24

[56] References Cited

U.S. PATENT DOCUMENTS

| | | | |
|---|---|---|---|
| 171,495 | 12/1875 | Amberg | 312/234.5 |
| 184,375 | 11/1876 | Hansen | 312/329 X |
| 793,642 | 7/1905 | Drain | 312/234.3 X |
| 1,471,757 | 10/1923 | Thiriot | 312/328 X |
| 2,058,648 | 10/1936 | Wellman . | |
| 2,137,420 | 10/1938 | Soybel . | |
| 2,168,240 | 8/1939 | Roberts . | |
| 2,320,159 | 5/1943 | Smith . | |
| 2,432,445 | 12/1947 | Roe . | |
| 2,443,837 | 6/1948 | Smith . | |
| 2,525,002 | 10/1950 | Smith . | |
| 2,619,150 | 11/1952 | Smith . | |
| 2,740,471 | 4/1956 | Follett . | |
| 3,028,206 | 4/1962 | Smith . | |
| 3,161,158 | 12/1964 | Lurey . | |
| 3,297,377 | 1/1967 | Smith . | |
| 3,343,248 | 9/1967 | Smith . | |
| 3,771,847 | 11/1973 | Aylworth . | |
| 4,554,760 | 11/1985 | Ponzo | 43/105 |
| 4,913,297 | 4/1990 | Wells . | |
| 5,171,076 | 12/1992 | Eming . | |
| 5,402,988 | 4/1995 | Eisele | 256/24 |

*Primary Examiner*—Anthony Knight
*Assistant Examiner*—Karlena D. Schwing
*Attorney, Agent, or Firm*—Tsugihiko Szuki; John L. James

[57] ABSTRACT

Display cabinet comprises a housing and a front door for closing the open front of the housing. The front door is connected to one of the housing walls for movement between the closed position and the opened position. The front door comprises a first panel member connected to the one housing wall for pivotal movement about a first axis, and a second panel member connected to the first panel member for pivotal movement about a second axis. The first and second axes are disposed generally parallel to each other such that when the front door is in the closed position, the first and second panel members lie in the same plane, and when the front door is in the opened position, the first and second panel members take an erected form of a V-shaped cross section which erected form has an edge extending along the second axis.

7 Claims, 4 Drawing Sheets

MERCHANDISING DISPLAY CABINET

BACKGROUND OF THE INVENTION

The present invention relates generally to merchandising display cabinets for outdoor use and, more particularly, to an outdoor display cabinet which has a cabinet-retained front door convertible into a sign structure.

Outdoor display cabinets such as motor oil display cabinets at automobile service stations typically utilize front and/or rear cover panels or doors for closing the cabinet to protect the displayed contents when the service station is not operating. When the cabinet is opened for services, these cover panels must be moved to a certain position such as a remote storage location where the panels do not block the open front or back of the cabinet. Frequently, storage space for such cover panels in service stations is not convenient.

U.S. Pat. No. 3,028,206 discloses an outdoor display cabinet having a pair of removable panels for covering the display areas of the cabinet. The cover panels in this patent are so constructed that when removed from the cabinet, they can be secured together to form a self-standing sign structure. This dispenses with a storage space for the removed cover panels. However, daily removal and reinstallation of the removable cover panels are still annoying duties to those who attend to the cabinet.

U.S. Pat. No. 3,297,377 discloses an outdoor display cabinet having cabinet-retained cover panels for locking the cabinet. The cover panels are slidably and concealably connected to the cabinet so that it can be retained together with the cabinet even when the cabinet is opened. This arrangement, however, requires an elaborate structure including the panel-guiding tracks, the panel-accommodating internal space and a number of the panel-constituting slats.

What is needed, therefore, is a display cabinet with a cover panel or door which is simple in structure and easy to attend to. Such a cabinet should obviate the necessity of removing cover panels and should still be capable of preventing pilfering.

SUMMARY OF THE INVENTION

The present invention provides a display cabinet which comprises a housing and a front door. The housing includes housing walls such as top and side walls. The housing walls define a display area where articles such as multiple can packages are accommodated and an open front for providing access to the articles within the display area. The front door is connected to one of the housing walls so that it is movable between a closed position and an opened position. In the closed position, the front door covers the open front of the housing whereas in the opened position, the front door is located outside the housing and permit access to the displayed articles. The front door comprises first and second panel members. The first panel member is connected to the housing one wall for pivotal movement about a first axis while the second panel member is connected to the first panel member for pivotal movement about a second axis. The first and second axes are disposed generally parallel to each other such that when the front door is in the closed position, the first and second panel members lie in a plane, and when the front door is in the opened position, the first and second panel members take an erected form of a V-shaped cross section. The erected form having the V-shaped cross section has an edge extending along the second axis.

In a preferred embodiment, a triangular tubular structure is formed by the one wall and the first and second panel members when the front door is in the opened position, In another preferred embodiment, the one housing wall is the top wall of the housing, and the erected form is a form of a gable roof disposed on the top wall, in which the ridge of the gable roof form extends along the second axis. In this embodiment, stopper means having an upright engaging surface may be provided to engage the second panel member to retain the front door in the gable roof form. The stopper means may be provided by a part of a housing framework for supporting the top wall. The second panel member may include a tab projecting therefrom for engagement with the upright engaging surface. Such a tab may be a hasp for locking the front door in the closed position. The framework may comprise a pair of opposed upper side members interconnected by an upper rear cross member to form a generally U-shaped structure, and the stopper means may be provided by the upper rear cross member.

In an alternative embodiment, the one housing wall is one of opposite side walls of the housing, and the erected form is a form of a two-panel folding screen set up alongside the one side wall.

In a further preferred embodiment, at least one of the first and second panel members comprise means for carrying graphics thereon. The carrying means is arranged such that when the front door is in the closed position, the carrying means faces inwardly of the housing, and when the front door is in the opened position, the carrying means is exposed to view so that the erected form serves as a sign structure for displaying suitable advertising subject matter. At least one of the panel members may include a grid and a billboard panel disposed along the grid. In this case, the inside surface of the billboard panel may provide the carrying means.

The present invention also provides a display cabinet having a front door pivotally connected to one of the housing walls along a first pivotal axis for movement between a closed position and an opened position. The front door comprises at least three panel members connected together in series for pivotal movement about parallel second axes with respect to each other. The second axes are disposed generally parallel to the first axis such that when the front door is in the closed position, all the panel members lie in a plane, and when the front door is in the opened position, two of the panel members take an erected form of a V-shaped cross section. A triangular tubular structure may be formed by the panel members when the front door is in the opened position.

The objects and advantages of the present invention will be apparent from the following description, the accompanying drawings and the appended claims.

BRIEF DESCRIPTION OF THE DRAWINGS

In the,drawings.

Figure 1:
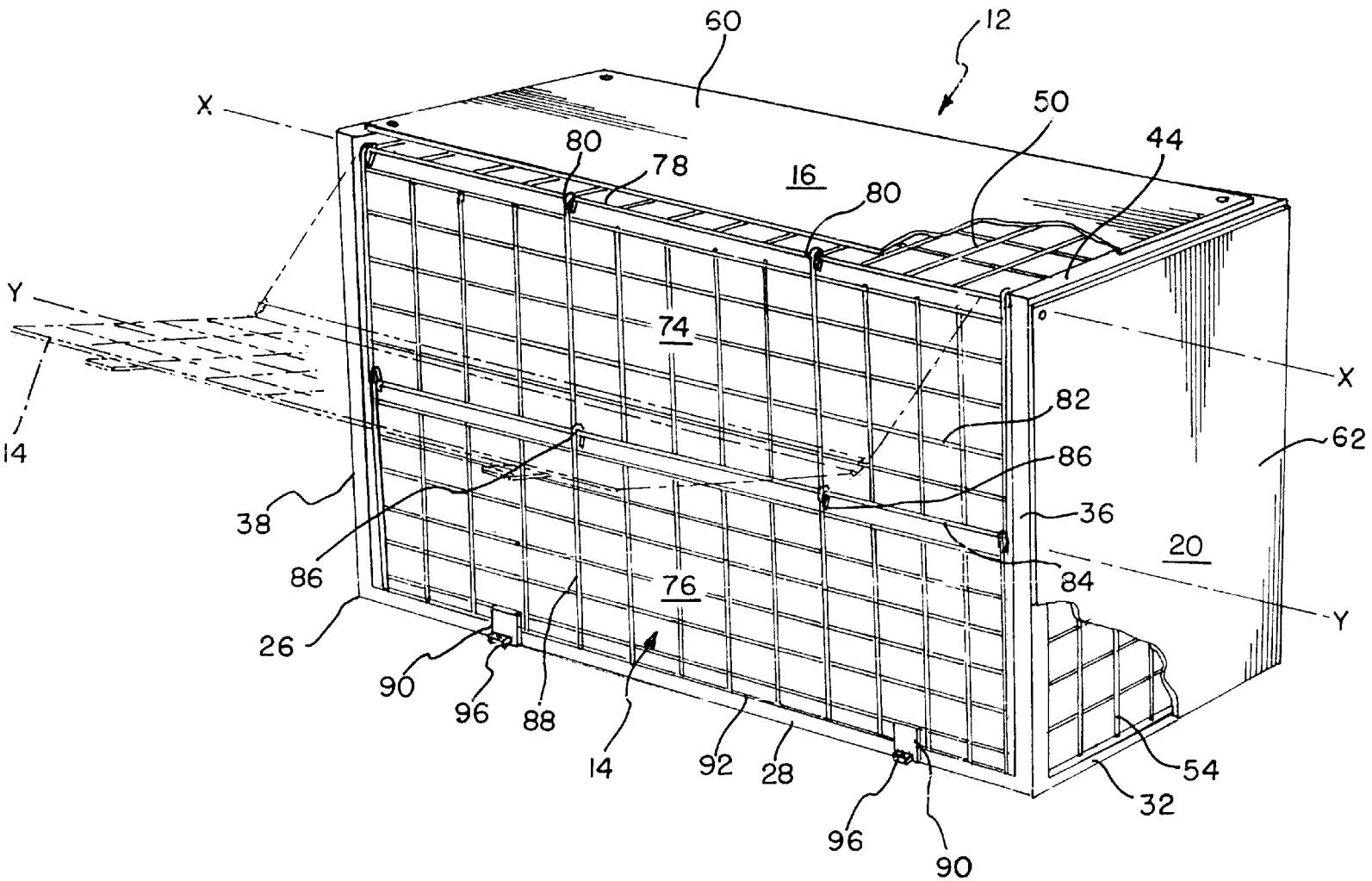
FIG. 1 is a top, right and front perspective view of a display cabinet according to the present invention, showing the front door in the closed position.
Figure 4:
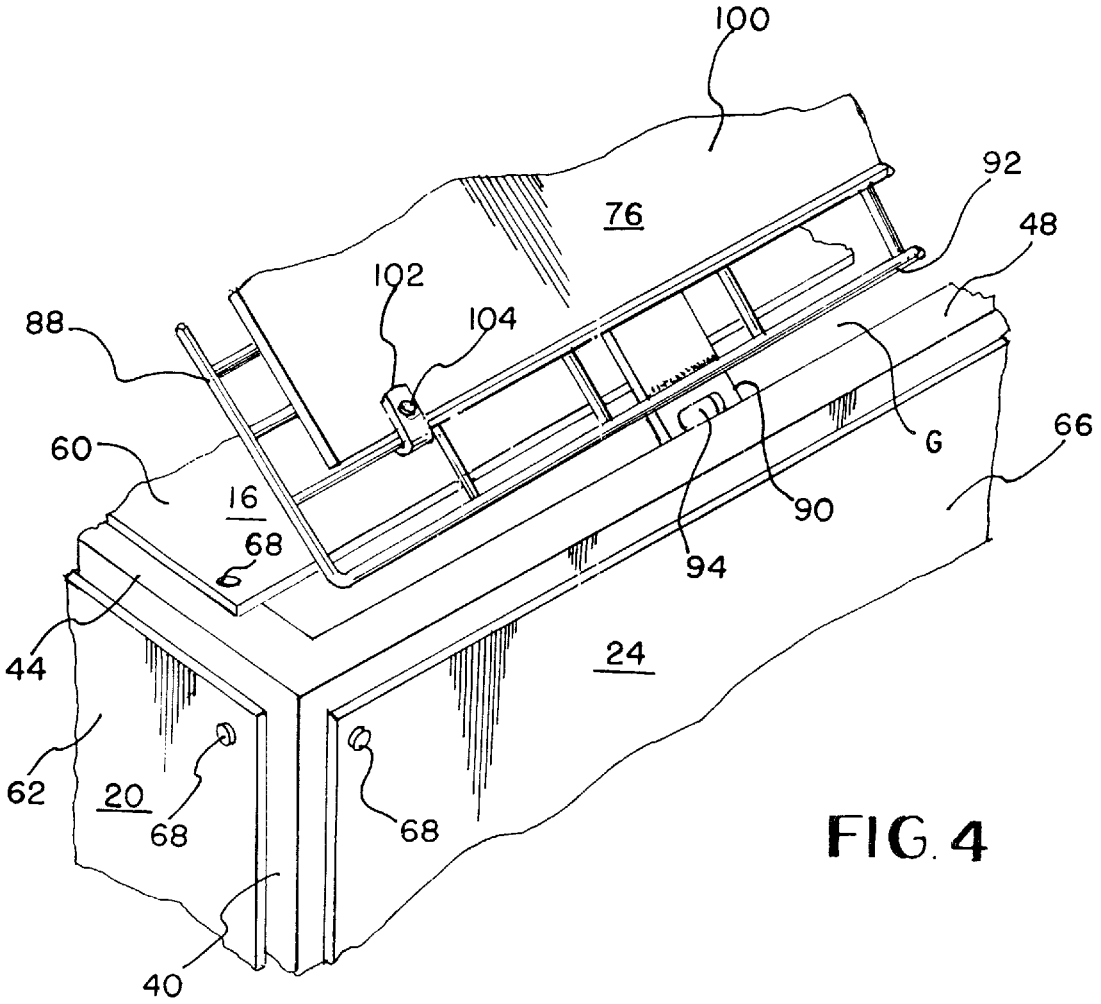
Figure 3:
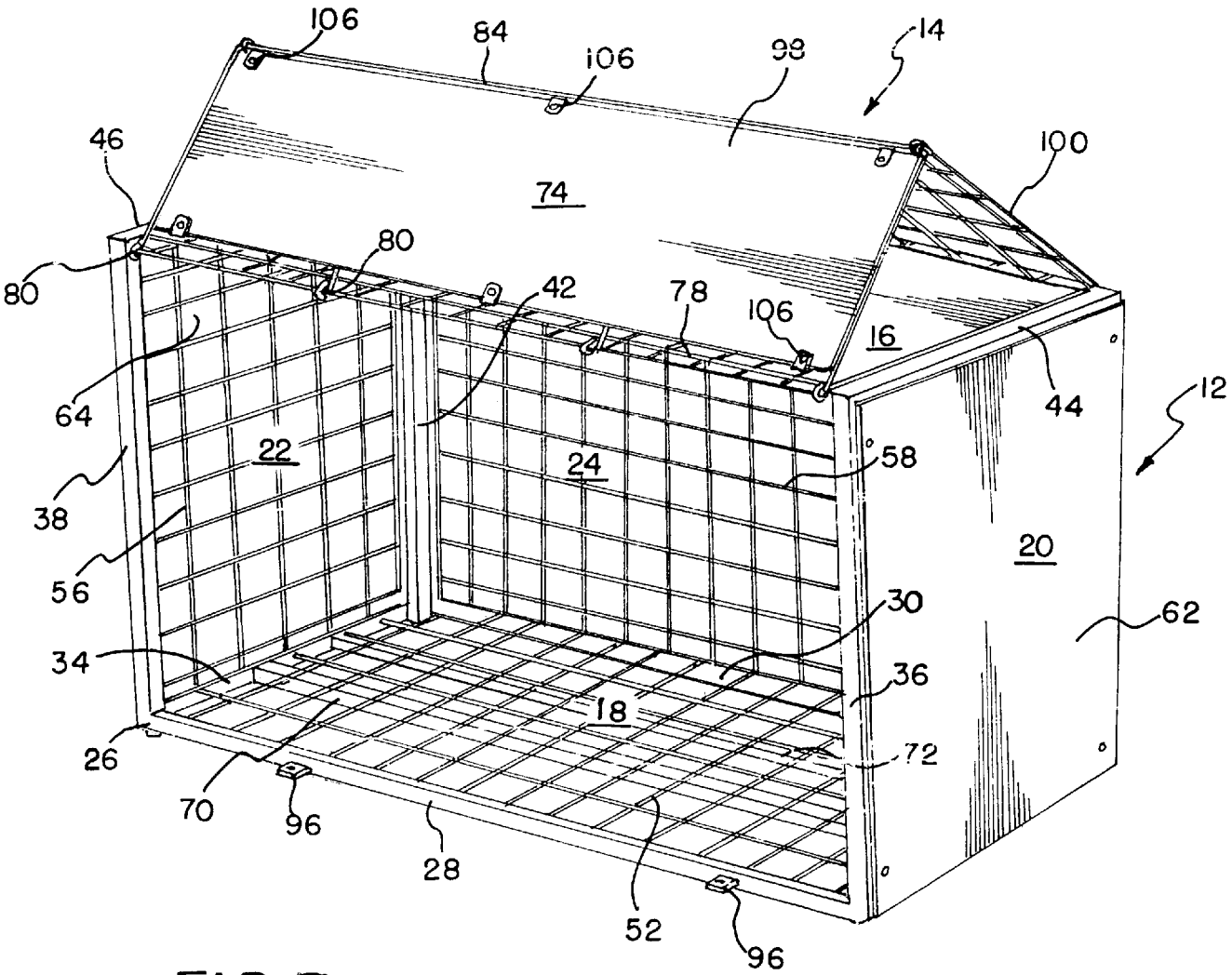
Figure 5:
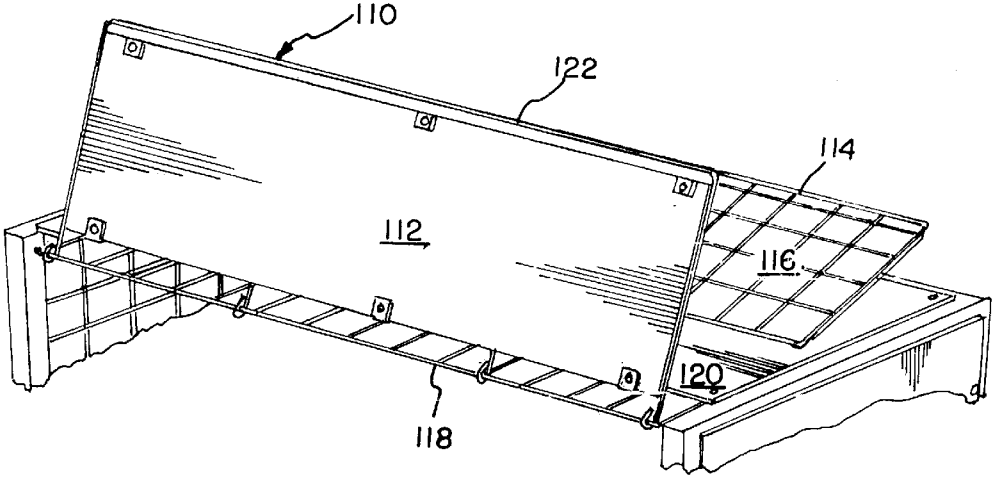
Figure 6:
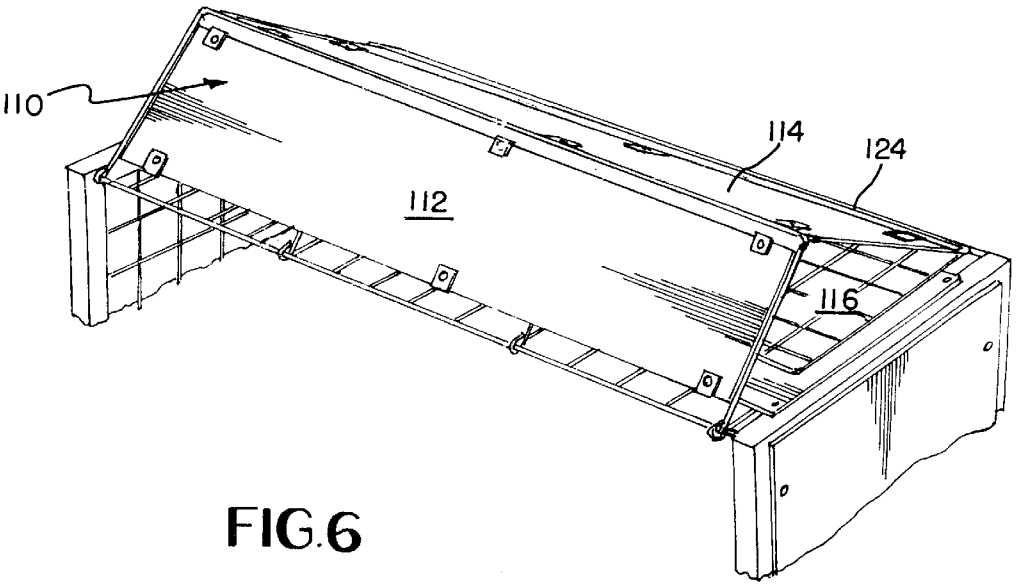

FIG. is an enlarged fragmentary left-front perspective view of the cabinet in FIG. 1, showing the lower-left portion of the second panel member;

FIG. 3 is a top, right and front perspective view of the display cabinet in FIG. 1, showing the front door in the opened position;

FIG. 4 is an enlarged fragmentary top, right and rear perspective view of the cabinet in FIG. 1, showing the hasp in engagement with the upper rear cross member of the housing framework;

FIG. 5 is a fragmentary top, right and front perspective view of the second embodiment of a display cabinet according to the present invention, showing the front door in the process of being folded into an erected form; and FIG. 6 is a fragmentary top, right and front perspective views of the cabinet in FIG. 5, showing the front door in the opened, erected position.

DETAILED DESCRIPTION OF THE PREFERRED EMBODIMENTS

With reference to FIGS. 1–4, there is illustrated a preferred embodiment of a display cabinet according to the present invention. The cabinet is designed to store and to display a plurality of multiple can/bottle packages such as beverage can packages, motor oil can packages or the like. Such packages, typically, are displayed in the cabinet in a stacked fashion. The illustrated cabinet includes a housing 12 and a front door 14.

The housing 12 includes opposed top and bottom horizontal walls 16 and 18, a pair of opposed side vertical walls 20 and 22 extending between the top and bottom walls 16 and 18 and a rear vertical wall 24 extending between the side walls 20 and 22. Each housing wall 16, 18, 20, 22 and 24 may be formed of any sturdy material such as hard plastic board, metal panel or the like; however, it is preferably formed of wire grid. The respective wire grids 50, 52, 54, 56 and 58 of the walls 16, 18, 20, 22 and 24 are interconnected by means of a framework 26 to form a rectangular box structure having an open front (shown in FIG. 3). The framework 26 is preferably formed of metal such as steel tubing and includes front and rear lower cross members 28 and 30 connected together by a pair of opposed lower side members 32 and 34 to form a rectangular base frame, four corner post members 36, 38, 40 and 42 upstanding from the base frame, a pair of opposed upper side members 44 and 46 interconnected by an upper rear cross member 48. These frame members 28, 30, 32, 34, 36, 38, 40, 42, 44, 46 and 48 are welded together to form the framework 26.

Each housing wall is supported or retained in position by the adjacent frame members extending along the perimeter of that wall. More particularly, the top wall 16 is supported in position by the upper side members 44 and 46 and the upper rear cross member 48 whereas the bottom wall 18 is retained in position by the front and rear lower cross members 28 and 30 and the lower side members 32 and 34. The side wall 20 is retained by the corner post members 36 and 40 (shown in FIG. 4) and the upper and lower side members 44 and 32 while the side wall 22 by the corner post members 38 and 42 and the upper and lower side members 46 and 34. The rear wall 24 is supported by the corner post members 40 and 42 and the upper and lower rear cross members 48 (shown in FIG. 4) and 30. Some of the wire grid elements of each housing wall are received at their opposite ends by apertures (not shown) formed in the tube wall of the adjacent frame members, and is thereby secured to the framework 26.

The housing walls 16, 20, 22 and 24 additionally include billboard panels 60, 62, 64 and 66, respectively. Each billboard panel 60, 62, 64 and 66 is disposed alongside the outer side of the respective wire grid 50, 54, 56 and 58 and is attached to the adjacent frame members by any suitable means such as plastic fasteners, cotter pins, rivets, screws, or the like. FIG. 4 shows so called Christmas tree fasteners 68 utilized as the means for attaching the billboard panels. The fasteners 68 are received at their ends in apertures (not shown) in the adjacent frame members to hold the respective billboard panel. The bottom wall 18 has no billboard panel but includes reinforcing beams 70 and 72 welded to and extending between the lower side members 32 and 34. The reinforcing beams 70 and 72 are disposed under the wire grid 52 and assist in bearing the load of the merchandise to be accommodated in the housing 12.

The front door 14 is provided to cover the open front of the housing 12 to prevent pilfering when the retail store or service station where the cabinet is installed is not operating. FIG. 1 shows the front door 14 in the position where it fully closes the open front of the housing 12. The front door 14 includes upper and lower panel members 74 and 76 each preferably formed of wire grid. The panel members 74 and 76 lie in a common vertical plane when the front door 14 is in the closed position as shown in FIG. 1.

Referring to FIG. 1, the upper panel member 74 is pivotally connected to the top wall 16 for upward and downward movement about a first horizontal axis X—X that is coaxial with the foremost transverse wire element 78 of the top wall grid 50. The pivotal joint between the upper panel member 74 and the top wall 16 is formed by the looped upper ends 80 of some of the vertical wire elements of the upper panel member grid 82. The wire element 78 passes through the looped ends 80 so that the looped ends 80 serve as knuckles disposed around the wire element 78.

Figure 2:
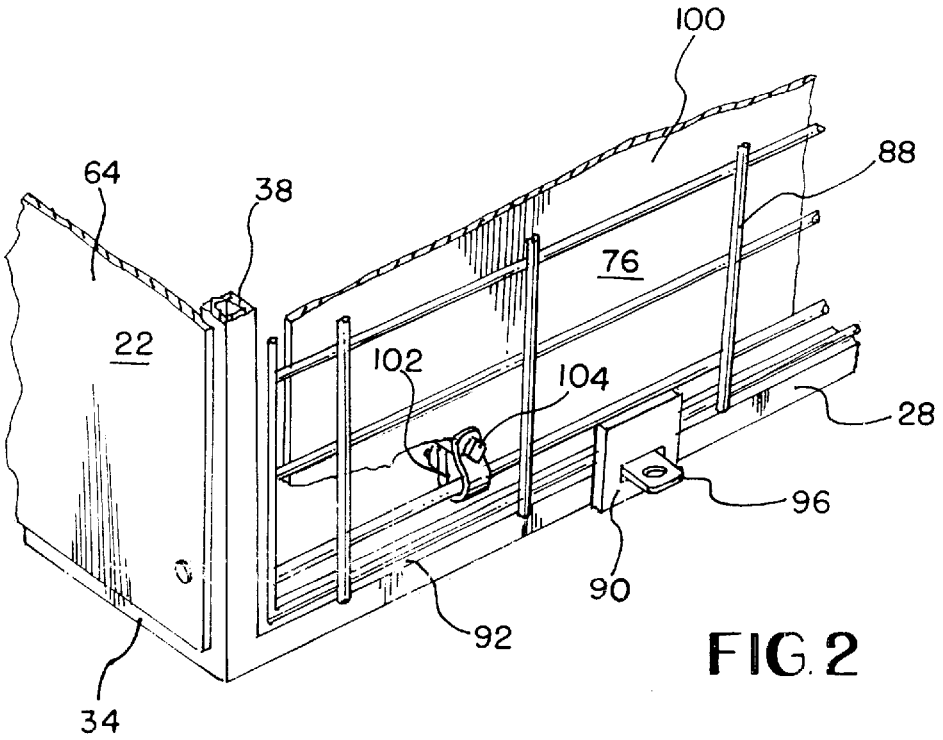

Referring further to FIG. 1, the lower panel member 76 is pivotally connected to the upper panel member 74 for pivotal movement about a second horizontal axis Y—Y. The second axis Y—Y is coincidental with the lowermost transverse wire element 84 of the upper panel member grid 82, which element 84 is parallel to the wire element 78 of the top wall grid 50. The pivotal joint between the upper and lower panel members 74 and 76 is formed by the looped upper ends 86 of some of the vertical wire elements of the lower panel member grid 88. The wire element 84 passes through the looped ends 86 so that the looped ends 86 serve as knuckles disposed around the wire element 84. A pair of hasps 90 are welded to the wire grid 88 of the lower panel member 76. These hasps 90 project downwardly from the lowermost wire element 92 of the grid 88 to receive in their slots 94 (only one shown in FIG. 4) complementary staples 96, respectively. The staples 96, as best shown in FIG. 3, are secured to the lower front cross member 28 of the framework 26. These hasps 90 and staples 96 are utilized in association with conventional padlocks to lock the front door 14 in the closed position. One of the hasps 90 in engagement with the associated staple 96 is shown in FIG. 2.

The upper and lower panel members 74 and 76 also include billboard panels 98 and 100, respectively. Each billboard panel 98 and 100 (shown in FIGS. 3 and 4) is disposed alongside the inner side (as viewed in FIG. 1) of the respective wire grid 82 and 88 and is attached to the same wire grid by, for example, pairs of a C-shaped clip 102 and a plastic rivet 104 as shown in FIG. 2. Such C-shaped clips 102 are placed on the respective wire grid such that each clip 102 receives between its opposed legs both a wire element and an edge of the respective billboard panel. Each plastic rivet 104 passes through the legs of the associated clip 102 as well as that part of the billboard panel between the legs. FIG. 3 shows six pairs 106 of a clip and a rivet utilized to attach the billboard panel 98 to the wire grid 88. Each billboard panel 98 and 100 is double-sided; it carries on its opposite sides graphic information such as advertisement of the merchandise to be displayed in the cabinet. The graphic information on the respective outer sides (as viewed in FIG. 1) of the billboard panels 98 and 100 is exposed to view through the wire grids 82 and 88 when the front door 14 is in the closed position. The inner sides of the panels 98 and 100 face inwardly of the housing 12 in FIG. 1, and thus the graphic information thereon is hidden from view. However, the information on the inner sides will also be exposed to view when the front door is opened as will be described later.

To open the cabinet, the front door 14 is pivoted upwards about the wire elements 78 and 84 until it is finally brought to the opened position on the top wall 16 as shown in FIG. 3. The phantom lines in FIG. 1 illustrates the front door 14 in a half opened position. When the door 14 is in the fully opened position as in FIG. 3, the upper and lower panel members 74 and 76 are arranged such that they assume the form of a gable roof having a V-shaped cross section. Such a gable roof form has a ridge extending along the wire element 84. In other words, a triangular tubular structure is formed by the top wall 16 and the upper and lower panel members 74 and 76. In the gable roof form, the inner sides of the billboard panels 98 and 100 are exposed to view as shown in FIG. 3 so that the gable roof form serves as a sign structure. Also in this form, the hasps 90 on the lower panel member 76, as shown in FIG. 4, are inserted into the gap "G" between the upper rear cross member 48 and the rear edge of the top wall billboard panel 60 and are disposed in abutment on a stopper in the form of the upright surface of the upper rear cross member 48. By this means, the front door 14 is retained in the gable roof form.

FIGS. 5 and 6 illustrate a second embodiment of the invention in which the display cabinet is provided with a front door 110 consisting of three panel members 112, 114 and 116 connected together in series. The panel member 112 is pivotally connected to the top wall 120 for movement about a horizontal axis coincidental with the foremost transverse wire element 118 of the top wall wire grid. The intermediate panel member 114 is pivotally connected to the first panel member 112 for movement about a horizontal axis coincidental with the topmost (as viewed in FIG. 5) transverse wire element 122 of the panel member 112. The third panel member 116 is pivotally connected to the intermediate panel member 114 for movement about a horizontal axis coaxial with the lowermost transverse wire 124 element of the panel member 114. The pivotal joint between the adjacent panel members is virtually identical to that described in the foregoing embodiment. The pivotal axes 118, 122 and 124 are parallel to each other so that when the front door 110 is in the closed position, the three panel members 112, 114 and 116 lie in the same vertical plane, and when the front door 110 is in the opened position as shown in FIG. 6, the three panel members 112, 114 and 116 form a tubular sign structure. In the arrangement in FIG. 6, the first and intermediate panel members 112 and 114 form a gable roof having a V-shaped cross section and the third panel member 116 lies in flat face contacting relationship with the top wall 120. However, in an alternative arrangement, the first panel member 112 may be in flat face contacting relationship with the top panel member 120 and the panel members 114 and 116 may form a gable roof structure.

It should be recognized that the cabinets in the forgoing embodiments may be re-oriented as necessary or as desired to make the top wall as a side wall. In the re-oriented condition, the front door, or a part of the front door, forms a two-panel folding screen alongside the side wall when brought into the opened position.

It should be also recognized that rather than the housing being formed from the steel framework and the wire grids, it may be formed from molded plastic.

It should be further recognized that the present invention is also useful with a cabinet having not only an open front but also an open back. For such cabinet, each of the open front and the open back is provided with the door convertible into a triangular sign structure either on the top wall or alongside the side wall(s).

It should be still further recognized that any suitable projections, latches, hooks or the like may be provided on the framework such as at upper rear cross member and/or at the upper side members to serve as stoppers for engagement with a gable roof-forming panel member. Alternatively or coexistently, hooks, anchors or the like may be provided for the front door to hook the top wall or a side wall so that the door is retained in the erected form.

What is claimed is:

1. A display cabinet comprising:

a housing including a plurality of walls defining a display area for accommodating articles and an open front for providing access to said articles in said display area, said walls including a top wall;

a front door connected to said top wall of said housing for movement between a closed position where said front door covers said open front and an opened position on said top wall, said front door comprising a first panel member connected to said top wall for pivotal movement about a first axis, and a second panel member connected to said first panel member for pivotal movement about a second axis, said first and second axes being disposed generally parallel to each other such that when said front door is in said closed position, said first and second panel members lie in a plane, and when said front door is in said opened position, said first and second panel members take an erected form of a gable roof disposed along said top wall, said erected form having a ridge along said second axis;

a stopper means having an upright engaging surface for engaging said second panel member to retain said front door in said form of said gable roof; and a tab projecting from said second panel member for engagement with said upright engaging surface.

2. The display cabinet according to claim 1, wherein when said front door is in said opened position, a triangular tubular structure is formed by said first and second panel members and said top wall.

3. The display cabinet according to claim 1, wherein said housing further includes a framework for supporting said walls in position, and said stopper means is provided by a part of said framework for supporting said top wall.

4. The display cabinet according to claim 3, wherein said framework comprises a pair of opposed upper side members interconnected by an upper rear cross member to form a generally U-shaped structure, and said stopper means is provided by said upper rear cross member.

5. The display cabinet according to claim 1, wherein said tab comprises a hasp for locking said front door in said closed position.

6. The display cabinet according to claim 1, wherein at least one of said first and second panel members comprises means for carrying graphics thereon, and said carrying means is arranged such that when said front door is in said position said carrying means faces inwardly of said housing and is hidden from view, and when said front door is in said opened position said carrying means is exposed to view so that said erected form serves as a sign structure.

7. The display cabinet according to claim 10, wherein said one panel member comprises a grid and a billboard panel disposed along the grid, and said carrying means comprises an inside surface of said billboard panel member.

* * * * *